United States Patent [19]

Annoot

[11] Patent Number: 4,609,247

[45] Date of Patent: Sep. 2, 1986

[54] CONNECTOR HAVING TWO SEAL-RINGS OF DIFFERENT DIAMETERS

[75] Inventor: Ira R. Annoot, Pasadena, Tex.

[73] Assignee: Houston Geophysical Products, Inc., Houston, Tex.

[21] Appl. No.: 512,604

[22] Filed: Jul. 11, 1983

[51] Int. Cl.[4] ..... H01R 11/00

[52] U.S. Cl. ..... 339/60 M; 339/49 R; 339/94 M

[58] Field of Search ..... 339/61 R, 61 M, 62, 339/63 R, 63 M, 47 R, 49 R, 154 R, 154 A, 156 R, 166 R, 153, 94 R, 94 M, 60 R, 60 C, 60 M, 105

[56] References Cited

U.S. PATENT DOCUMENTS

| | | | |
|---|---|---|---|
| 2,015,590 | 9/1935 | Cavanagh et al. | 339/60 R |
| 2,037,630 | 4/1936 | Hudson | 339/60 R |
| 2,934,668 | 4/1960 | Dall | 339/60 C |
| 3,121,598 | 2/1964 | Mavasco | 339/60 R |
| 3,124,405 | 3/1964 | Massa | 339/60 R |
| 3,474,386 | 10/1969 | Link | 339/60 R |
| 3,611,255 | 10/1971 | Shroyer | 339/60 R |
| 3,665,368 | 5/1972 | Ellis | 339/60 R |
| 3,907,395 | 9/1975 | Flanagan | 339/99 R |
| 3,960,433 | 6/1976 | Boliver | 339/111 |
| 3,998,515 | 12/1976 | Panek | 339/94 A |
| 4,445,741 | 5/1984 | Annoot | 339/49 R |

FOREIGN PATENT DOCUMENTS

| | | | |
|---|---|---|---|
| 0554843 | 7/1943 | United Kingdom | 339/60 R |

*Primary Examiner*—Gil Weidenfeld
*Assistant Examiner*—Thomas M. Kline
*Attorney, Agent, or Firm*—Michael P. Breston

[57] ABSTRACT

The male connector plug has a cylindrical body portion which has a forward cylindrical section of a smaller diameter and a rear cylindrical section of a larger diameter. Each such body section is surrounded by an O-ring. The mating female connector plug has a tubular body portion whose bore defines a forward cylindrical bore section of a larger-diameter and a rear cylindrical bore section of a smaller diameter. Each bore section has an annular groove therein.

3 Claims, 6 Drawing Figures

CONNECTOR HAVING TWO SEAL-RINGS OF DIFFERENT DIAMETERS

BACKGROUND OF THE INVENTION

1. Field of the Invention.

This invention relates to connectors in general and in particular to seismic connectors which can be single ended or double ended.

2. Description of the Prior Art.

This invention relates to the geophone stringing art and, more particularly, to a hybrid seismic takeout connector, known in the art as a "hybrid clip" which is adapted to connect two conductors from a geophone leader cable to two male and female contacts of the clip, and then to interconnect several such clips together in various series and parallel combinations.

This is necessary because in seismic prospecting, a plurality of geophone strings is normally required for each channel of data to be recorded, and a means must be provided for electrically interconnecting together this plurality of strings. On each string, the geophones are spaced along and are electrically connected by suitable means to the leader cable. Each such string has one or more hybrid clips installed on the geophone leader termination. The leader cable of the hybrid clip electrically connects the geophone strings to one or more two-wire takeout connectors on the spread cable.

Currently it is a common practice to use only two conductors for connecting strings of geophones to a single takeout connector on the spread cable for a particular channel forming part of the seismic recording instruments. Since it is preferred that the spread cable be provided with only one two-wire takeout for each seismic data recording channel, it is necessary to electrically interconnect in parallel and/or in series the geophone strings to form a geophone group that will be used for each channel, and then to connect the group thus formed to the corresponding takeout connector on the spread cable for that particular channel.

U.S. Pat. No. 3,907,393 describes a hybrid takeout clip for interconnecting groups of such geophone strings, and also describes the art prior to the invention claimed in said patent. This patented hybrid clip has rapidly met with considerable commercial success primarily because of its quick connect and disconnect characteristics and because it combines several desirable functions previously performed by single-ended connectors and by T-couplers.

It was found, however, that when the exposed contacts of the patented hybrid clip touch the earth or when they become exposed to moisture, unwanted noise signals become generated across its exposed electric contacts, and in the extreme case, these contacts become grounded. Such unwanted noise signals combine with the desired detected output signals from the geophones to give an undesirable high noise-to-signal ratio.

An improved double-ended, single O-ring hybrid takeout clip is disclosed in my copending patent application, Ser. No. 310,387, and now U.S. Pat. No. 4,445,741.

This improved hybrid takeout clip has at one end a solid male plug provided with a single O-ring, and a tubular female plug provided with a single groove for accepting the male plug with its O-ring.

Also, a single-ended solid cylindrical male connector, having a pair of equal diameter O-rings around the cylindrical body portion of the male plug, and a single tubular female connector, having a pair of equal diameter inner annular grooves in the tubular female plug, are also known in the seismic art. The body portions of these single plugs are dimensioned to allow, in use, the tubular female plug to snugly accept therein the male plug, whereby the two grooves frictionally and consecutively receive the two O-rings for protecting the interconnected electric contacts of the male and female plugs against moisture penetration between and disconnection of the plugs.

While the two equal-diameter O-rings provide greater protection against moisture penetration and disconnection, a connector using them does have known drawbacks: (1) the male and female plugs are difficult to align prior to coupling; the two O-rings become seated consecutively within their grooves, and in so doing they tend to bind the tubular body portion of the female plug thus creating excessive frictional engagement which requires a strong force to complete the coupling the male and female plugs.

SUMMARY OF THE INVENTION

The male connector plug of this invention has a cylindrical body portion which contains a pair of electric contacts. The cylindrical body portion has a forward cylindrical section of a smaller diameter and a rear cylindrical section of a larger diameter. Each such body section is surrounded by an O-ring.

The mating female connector plug of this invention has a tubular body portion defining a cylindrical bore which contains a pair of electric contacts. The bore defines a forward cylindrical bore section of a larger-diameter and a rear cylindrical bore section of a smaller diameter. Each bore section has an annular groove therein.

The forward and rear cylindrical body sections of the male plug, the corresponding mating rear and forward cylindrical bore sections of the female plug, and the axial spacing between the two O-rings and between the two grooves are so dimensioned as to allow, in use, the tubular female plug to snugly accept the male plug, whereby the two grooves substantially simultaneously frictionally receive the two O-rings and thus minimize frictional engagement between the O-rings and the wall of the bore in the female plug.

In a preferred embodiment there is provided a double-ended, seismic takeout clip which comprises an elongated unitary body made of an elastic insulating material. The male connector plug projects outwardly from one end of the clip's body and the tubular female plug projects outwardly from the opposite end of the body. The female plug snugly accepts a male plug of a second like takeout clip. A pair of longitudinal electric conductors are embedded within the body of the clip. Each conductor is electrically connected to, for providing a conductive path between, an electric contact in the male plug and an electric contact in the female plug. A pair of insulated wires project outwardly of the clip's body and are electrically connected across the pair of conductors and thus across the pair of contacts in each plug.

DETAILED DESCRIPTION OF PREFERRED EMBODIMENTS

Figures 1, 2, 3, 4, 5, 6:
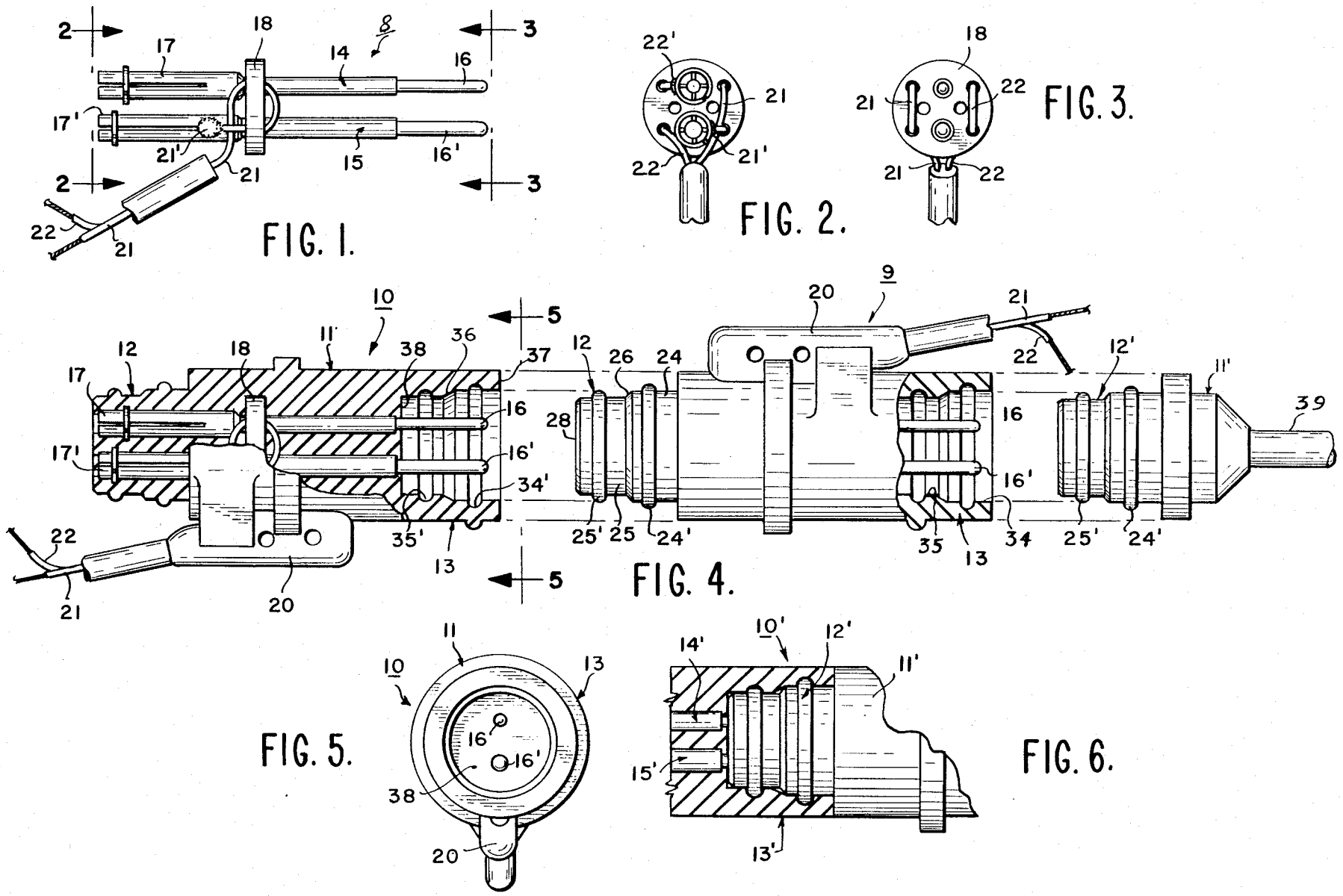
FIG. 1 is a front view of the electric contact assembly embedded within the double-ended connector of this invention.
FIGS. 2 and 3 are end views taken on lines 2—2, and 3—3 of FIG. 1, respectively.
FIG. 4 is an exploded front view, partly in section, of a double-ended connector and of a single-ended male plug connector of this invention.
FIG. 5 is an end view of the female plug taken on line 5—5 of FIG. 4.
FIG. 6 is a a fragmentary front view, partly in section, of a female plug connected to a male plug.

The invention is first illustrated in connection with a double-ended seismic takeout clip 10 having a male plug 12 and a female plug 13.

Clip 10 has a conductor sub-assembly 8 (FIGS. 1–3) which comprises a pair of conductors 14 and 15 that are rigidly maintained in parallel, longitudinal, spaced-apart relationship by an insulating cylindrical support 18. Conductors 14 and 15 have male electric contacts 16, 16' at one end, and female electric contacts 17, 17' at the opposite end. There is thus electric continuity between each pair of male and female contacts 16, 17 and 16', 17'.

A takeout cable 9 has a jacket 20 which contains a pair of insulated wires 21, 22 that are anchored to support member 18. Conductors 14 and 15 extend through a pair of main longitudinal bores, and each one of wires 21 and 22 loops around an auxiliary pair of holes in support 18. The bare end portion of wire 21 is soldered at 21' to conductor 15, and that of wire 22 is soldered at 22' to conductor 14.

The body 11 of clip 10 has a generally cylindrical configuration and is made of an insulating elastic material such as a neoprene compound measuring a hardness of about 60 DUR., on the Shore A Scale, A.S.T.M. 1415. The solid cylindrical male plug 12 projects outwardly from one end of body 11, and from its opposite end projects a tubular female cylindrical plug 13.

The conductor sub-assembly 8 is embedded within body 11. The male electric contacts 16, 16' are surrounded by the tubular body portion of female plug 13, and the female contacts 17, 17' are embedded within and do not project outside of male plug 12.

Male plug 12 has a cylindrical, smaller-diameter, forward section 25, and female plug 13 has a corresponding smaller-diameter rear bore section 35. Male plug 12 has a cylindrical, larger-diameter rear section 24, and female plug 13 has a corresponding larger-diameter forward bore section 34.

An O-ring 24' surrounds section 24 and an O-ring 25' surrounds section 25 of male plug 12. Each O-ring can be an annular projection of body 11 and has a substantially, semicircular cross section. Between sections 24, 25 is a tapered transition wall 26, and between sections 34, 35 is a tapered transition wall 36. Male plug 12 has a circular front face 28, and female plug 13 has a circular rear face 38.

The diameters of cylindrical sections 24 and 25 of male plug 12 are slightly less (say 0.005") than the diameters of their mating cylindrical bore sections 34, 35, respectively, so as to reduce the frictional engagement therebetween.

The outside diameter (say 0.585") of forward O-ring 25' is less than the diameter of forward bore section 34 (say 0.605") to allow forward section 25 of male plug 12 to penetrate without frictional engagement into forward bore section 34 of female plug 13. Such frictionless penetration tends to align rear section 24 of male plug 12 with its mating front bore section 34 of female plug 13.

In a preferred embodiment, the outside diameter of forward O-ring 25' is larger (say 0.585") than the diameter of rear bore section 35 (say 0.540") to allow O-ring 25' of male plug 12 to penetrate under friction into rear bore section 35 of female plug 13, and to seat in annular groove 35' of female plug 13. The outside diameter of rear O-ring 24' is larger (say 0.660") than the diameter of front bore section 35 (say 0.605") to allow O-ring 24' of male plug 12 to penetrate under friction into forward bore section 34 of female plug 13, and to seat in annular groove 34' of female plug 13.

In use, when male plug 12 and female plug 13 are first aligned and pushed for coupling with each other, forward section 25 of male plug 12 quickly and frictionlessly penetrates into forward bore section 34 of female plug 13. An additional push causes O-ring 25' of male plug 12 to frictionally penetrate into rear bore section 35 of female plug 13, and rear O-ring 24' of male plug 12 to frictionally penetrate into forward bore section 34 of female plug 13, until the grooves 34', 35' substantially simultaneously frictionally receive the O-rings 24', 25', respectively. When male plug 12 is fully pushed in into female plug 13, the front face 28 of male plug 12 abuts against the rear face 38 of female plug 13.

Such frictional engagements protect the interconnected electric contacts 16, 16" and 17, 17' against moisture penetration. These frictional engagements also resist accidental disconnection between male plug 12 and female plug 13.

Thus, by making the outside diameter of forward O-ring 25' slightly less than the diameter of forward bore section 34, the tendency of O-ring 25' to bind against the inner wall of bore section 34 is eliminated, and the total amount of frictional engagement encountered between the male and female plugs 12 and 13 is correspondingly reduced.

Thus, this invention makes it possible to obtain an optimum frictional engagement between O-rings 24', 25' and mating grooves 24', 35'. Such double frictional engagements provide double protection against moisture penetration into electric contact 16, 16' and 17, 17', as well as double protection against disconnection between the frictionally-engaged plugs 12 and 13.

Also, because the diameter of forward O-ring 25' is less than the diameter of rear O-ring 24', both O-rings 24', 25' become seated substantially simultaneously within their respective grooves 34', 35'. Conversely, when forward section 25 and O-ring 25' of male plug 12 have the same diameter as the rear section 24 and O-ring 24', respectively, and forward bore section 34 and forward annular groove 34' of female plug 13 have the same diameter as rear bore section 35 and rear annular groove 35', respectively, as in the prior art, it is relatively difficult to first align male plug 12 with female plug 13 prior to coupling them together. After having aligned them, a considerable amount of force is required to disengage O-ring 25' from groove 34', a necessary action to the seating of O-rings 24', 25' within their mating grooves 34', 35', respectively, if the forward section 25 and O-ring 25'of male plug 12 has the same diameter as rear section 24 and O-ring 24', and forward annular groove 34' of female plug 13 snugly accepts forward O-ring 25' of male plug 12, as in the prior art.

Consequently, by making forward section 25 have a lesser diameter than rear section 24, alignment of plugs 12 and 13 is made easier. Also, tapered transition wall 36 provides ease of entry of O-ring 25' into section 35, and less frictional engagement is encountered when coupling them together. Because of snug engagement of O-rings 24', 25' with their respective mating grooves 34', 35', accidental disconnection is prevented. These two important advantages of easy connection and firm resistance to disconnection provided by the invention are greatly appreciated by the seismic crew which is required to connect and disconnect the male and female plugs 12 and 13 many dozens of times during a single day of a seismic survey.

In use for geophone stringing, a string of geophones is connected to the insulated wires 21, 22 of takeout cable 9 on clip 10. By stacking and interconnecting several clips 10 together, a large group of geophone strings can be quickly electrically connected in series and/or parallel and such connections are doubly protected against moisture penetration and disconnection.

The thusly interconnected clips 10 can then be connected to a two-wire, seismic leader cable 39 having at the end thereof a single-ended male plug 12' (FIGS. 4, 6), which in all material respects is identical to plug 12 of clip 10.

Male plug 12' has a body 11' and can be quickly operatively coupled to a single-ended female plug 13' which is in all material respects identical to female plug 13, previously described, except that conductors 14' and 15' of plug 13' can be directly connected to a two-wire cable (not shown) similar to cable 39. In any event, as far as male plug 12' is concerned, it makes no difference to it whether it is connected to a single-ended female plug 13' or to a female plug 13 forming part of a double-ended clip 10.

For best results it was found that in the male plug the ratio between the smaller diameter of the forward section and the larger diameter of the rear section should be smaller than 10/10.5, and that in the female plug the ratio between the larger diameter of the forward bore section and the smaller diameter of the rear bore section should be larger than 1.05. Since the diameter of the smaller O-ring 25' surrounding the smaller diameter forward section 25 of male plug 12 is less than the diameter of the forward section 34 of female plug 13, and since rear section 24 of male plug 12 mates with forward section 34 of female plug 13, the maximum diameter of smaller O-ring 25' is less than the minimum or base diameter of the larger O-ring 24'. I achieve the functional advantages of double O-ring seals as well as optimum ease of engagement and disengagement of mating plugs 12 and 13, by making O-rings 24' and 25' to have different diameters, and by making the maximum (outside) diameter of smaller O-rings 25' less than the minimum (base) diameter of larger O-ring 24', as is more fully explained on pages 8 through 11.

In sum, the seismic connectors 10, 10' of this invention are especially adapted for stringing geophones and can be without much effort quickly interconnected and disconnected many times during a single day; when they are disconnected, their electric contacts 16, 16' and 17, 17' are insulated from ground by the insulating body 11; when they are coupled together, their electric contacts have double-O-ring protection against moisture penetration and disconnection. In this manner, the improved connectors 10, 10' of this invention reduce the amount of undesired noise signals which normally results when interconnecting clips that are less moisture-proof and have exposed electric contacts.

What I claim is:

1. A double-ended seismic takeout clip including:

a cylindrical male connector plug at one end thereof;

a cylindrical female connector plug at the opposite end thereof and being adapted to become operatively coupled with a male connector plug of an adjacent clip;

said male plug having a cylindrical, smaller-diameter forward body section and a cylindrical larger-diameter rear body section;

said female plug having a cylindrical, larger-diameter forward bore section and a cylindrical, smaller-diameter rear bore section, each bore section having an annular groove therein, and said grooves having differently sized diameters;

a seal-ring outwardly and radially extending from each one of said body sections, each seal-ring having an outer diameter, the outer diameter of said seal-ring on said smaller-diameter forward section is smaller than the outer diameter of said seal-ring on said larger-diameter rear section; and said seal-rings and said grooves being sized such that one seal-ring moves freely past the groove provided for the other seal-ring, whereby the wall of each one of said grooves engages the opposite sides of its mating seal ring when said male and female plugs are slideably mated together.

2. The Clip of claim 1, wherein the ratio between said smaller-diameter forward section of said male plug and said larger-diameter rear section of said male plug is less than 0.95.

3. A double-ended, siesmic takeout clip, comprising:

an elongated unitary body made of an insulating material;

a solid cylindrical male connector plug projecting outwardly from one end of said body and defining a forward cylindrical body section of a smaller diameter and a rear cylindrical body section of a larger diameter, and a seal-ring extending outwardly from each cylindrical body section;

a tubular female connector plug projecting outwardly from the opposite end of said body and defining a forward cylindrical bore section of a larger diameter and a rear cylindrical bore section of a smaller diameter, each bore section having an inner annular groove therein;

said male plug having a pair of electric contacts and said female plug having a pair of electric contacts;

the contacts of the male plug being adapted to mate with the contacts of the female plug of an adjacent clip;

the contacts of the female plug being adapted to mate with the contacts of the male plug of another adjacent clip;

said smaller diameter of said rear bore section and said larger diameter of said forward bore section of said female plug being dimensioned so that said forward male plug section is frictionally and slideably received by said rear bore section of its mating female plug, said rear male plug section is frictionally received by said forward bore section of its mating female plug, and the rear and forward seal-rings of said male plug becoming respectively and substantially-simultaneously seated within their mating grooves in said forward and rear bore sections of said female plug, whereby the wall of each one of said grooves engages the opposite sides of its mating seal ring;

a pair of longitudinal electric conductors embedded within said clip body for providing conductive paths between the pairs of electric contacts in said male and female plugs on the opposite ends of said body; and a cable having a pair of insulated wires, each wire having an inner end whose bare metallic end portion makes an electric connection with one of said conductors inside said clip body, and each wire having an outer end which projects outwardly of said clip body.

* * * * *